US008854407B2

(12) United States Patent
Kamei

(10) Patent No.: US 8,854,407 B2
(45) Date of Patent: Oct. 7, 2014

(54) IMAGE FORMING APPARATUS THAT FORMS IMAGE USING MULTIPLE LIGHT EMITTING ELEMENTS

(71) Applicant: Canon Kabushiki Kaisha, Tokyo (JP)

(72) Inventor: Yasuo Kamei, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 28 days.

(21) Appl. No.: 13/688,533

(22) Filed: Nov. 29, 2012

(65) Prior Publication Data

US 2013/0155164 A1 Jun. 20, 2013

(30) Foreign Application Priority Data

Dec. 20, 2011 (JP) ..... 2011-278752

(51) Int. Cl.

| | |
|---|---|
| ***B41J 2/45*** | (2006.01) |
| ***B41J 2/435*** | (2006.01) |
| ***B41J 2/47*** | (2006.01) |
| ***G03G 15/043*** | (2006.01) |
| ***G03G 15/04*** | (2006.01) |

(52) U.S. Cl.

CPC ..... *G03G 15/04054* (2013.01); *G03G 15/043* (2013.01)

USPC ..... 347/238; 347/224; 347/229; 347/234; 347/236; 347/225; 347/253

(58) Field of Classification Search

USPC ..... 347/238, 224, 225, 229, 234, 236, 248, 347/253

See application file for complete search history.

(56) References Cited

U.S. PATENT DOCUMENTS

| | | | | |
|---|---|---|---|---|
| 2003/0218669 | A1* | 11/2003 | Lee | 347/238 |
| 2004/0125196 | A1* | 7/2004 | Nomura et al. | 347/236 |
| 2011/0221847 | A1* | 9/2011 | Takezawa | 347/118 |
| 2012/0075403 | A1* | 3/2012 | Nagamine et al. | 347/242 |

FOREIGN PATENT DOCUMENTS

| | | | |
|---|---|---|---|
| JP | 2002-55498 A | | 2/2002 |
| JP | 2002055498 A | * | 2/2002 |

* cited by examiner

*Primary Examiner* — Sarah Al Hashimi

(74) *Attorney, Agent, or Firm* — Fitzpatrick, Cella, Harper & Scinto

(57) ABSTRACT

An image-forming position displaces from an ideal position occurring due to a portion of a support substrate bending in a direction approaching a photosensitive drum. This displacement is set as a first gap data. Spot size expansion caused by bending of the support substrate can be reduced by using light amount control data that has been corrected in response to this first gap data. Furthermore, by using light amount control data corrected in response to second gap data that indicates displacement to an ideal position from exposure areas occurring due to decentering of the photosensitive drum, spot size expansion caused by decentering of the photosensitive drum can be reduced.

9 Claims, 7 Drawing Sheets

305

| | | TONE | | | | | | | | |
|---|---|---|---|---|---|---|---|---|---|---|
| | | 0 | 1 | 2 | 3 | ··· | 252 | 253 | 254 | 255 |
| GAP [100um] | 0 | 0 | 2 | 3 | | | | | | |
| | 1 | 0 | 2 | | | | | | | |
| | 2 | 0 | | | | | | | | |
| | 3 | | | | | | | | | |
| | ⋮ | | | | | | | | | |
| | 252 | | | | | | | | | |
| | 253 | | | | | | | | | 255 |
| | 254 | | | | | | | | 252 | 255 |
| | 255 | | | | | | | 251 | 252 | 255 |

| IMAGE DATA (INPUT) | 0 | 1 | 2 | 3 | ··· | 252 | 253 | 254 | 255 |
|---|---|---|---|---|---|---|---|---|---|
| EXPOSURE DATA (OUTPUT) | 0 | 2 | 3 | 4 | | 251 | 252 | 253 | 255 |

| IMAGE DATA (INPUT) | 0 | 1 | 2 | 3 | ... | 252 | 253 | 254 | 255 |
|---|---|---|---|---|---|---|---|---|---|
| EXPOSURE DATA (OUTPUT) | 0 | 3 | 4 | 5 | | 250 | 251 | 252 | 255 |

IMAGE FORMING APPARATUS THAT FORMS IMAGE USING MULTIPLE LIGHT EMITTING ELEMENTS

BACKGROUND OF THE INVENTION

1. Field of the Invention

The present invention relates to image forming apparatuses that form an image using multiple light emitting elements.

2. Description of the Related Art

LED (light emitting diode) systems are known as exposure systems that are employed in electrophotographic image forming apparatuses. In LED systems, an LED array is arranged in the lengthwise direction of a photosensitive drum. Furthermore, a rod lens array may also be provided that condenses the light outputted by the LED array onto the photosensitive drum.

With LED systems, sometimes the relative positional relationship between the LED array and the rod lens array will displace from the ideal relationship, or the relative positional relationship between the rod lens array and the surface of the photosensitive drum will displace from the ideal relationship. In this case, the spot produced on the photosensitive drum will expand undesirably from the ideal size. When the spot expands, it may undesirably overlap with a spot for forming another dot that is adjacent in the main scanning direction or sub scanning direction. This is referred to as spot interference. When spot interference occurs, density change (density unevenness) occurs in the halftones at the areas of interference. In particular, the amount of expansion of the spot related to the displacement in the positional relationship between the lens and the photosensitive drum tends to be greater in LED systems compared to laser beam scanning systems. This is because the distance from the lens to the photosensitive drum in LED systems is much shorter compared to this distance in laser beam scanning systems. Accordingly, mechanical adjustment mechanisms are employed in LED systems to adjust the interval between the LED head and the photosensitive drum.

On the other hand, Japanese Patent Laid Open No. 2002-055498 describes an invention in which an image sample is outputted and an imaging state of the spot is detected from a result of reading the outputted image sample such that density corrections are carried out using image processing in response to the state of imaging. With the invention in Japanese Patent Laid-Open No. 2002-055498, a mechanical adjustment mechanism becomes unnecessary, and therefore halftone density fluctuations caused by expansion of the spot size can be mitigated at low cost.

In this way, the invention described in Japanese Patent Laid-Open No. 2002-055498 is extremely outstanding in regard to the point of being capable of mitigating at low cost the halftone density fluctuations caused by expansion of the spot size. However, there is room for improvement in the invention described in Japanese Patent Laid-Open No. 2002-055498. This is not only because it necessitates a reading detection unit for the sample image, but also because image-forming position misidentification can occur due to error in the reading detection unit.

SUMMARY OF THE INVENTION

A feature of the present invention is that it mitigates fluctuation in spot size using a simple configuration without requiring a mechanical adjustment mechanism or a detection unit for sample images.

The present invention provides an image forming apparatus, comprising the following units. A head unit is provided with multiple light emitting elements and multiple imaging lenses. The multiple light emitting elements are configured to output light toward a rotationally driven image carrier and are disposed so as to illuminate different positions of the image carrier in a rotational axis (shaft) direction. The multiple imaging lenses are configured to cause light from the light emitting elements to form an image onto a surface of the image carrier. A light amount control data storage unit is configured to store light amount control data corresponding to multiple exposure areas respectively on the image carrier in the rotational direction of the image carrier. A control unit is configured to control a light amount of the light outputted from the multiple light emitting elements respectively based on light amount control data corresponding to the exposure areas opposing the multiple light emitting elements respectively.

Further features of the present invention will become apparent from the following description of exemplary embodiments (with reference to the attached drawings).

DESCRIPTION OF THE EMBODIMENTS

Overall Configuration of Image Forming Apparatus

Figure 1:
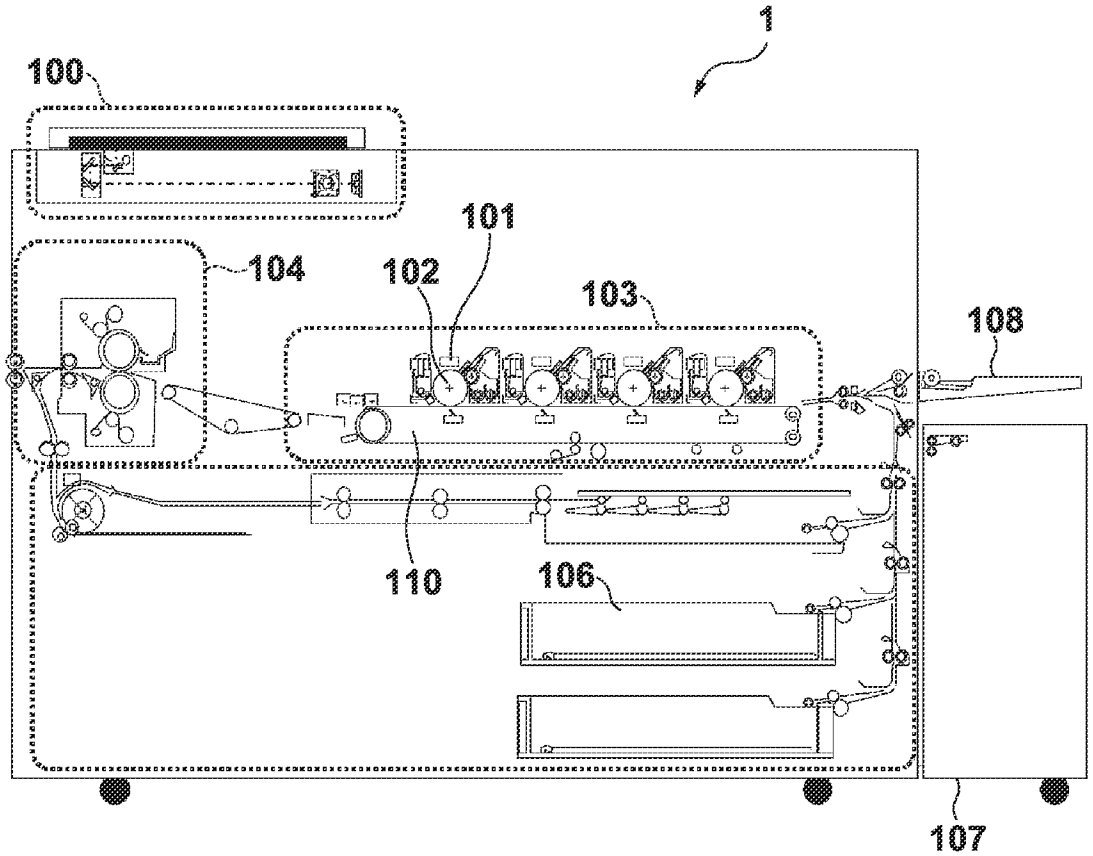
FIG. 1 is a cross-sectional view showing a configuration of an image forming apparatus.

Description is given using FIG. 1 regarding basic operations of a digital copier. An image forming apparatus 1 may be a printer, a copier, a multifunction device, or a fax machine or the like. An image reader 100 optically reads an image of an original by irradiating lighting onto an original placed on an original platform, then converts the image to electrical signals to generate image data. LED exposure units 101 irradiate light onto photosensitive drums 102 (photosensitive members, and objects to be scanned), which are image carriers, in response to the image data. An image forming unit 103 rotationally drives the photosensitive drums 102 and uniformly charges an exposure area of the surfaces thereof using a charger, then latent images formed by the LED exposure units 101 are developed by toner. The image forming unit 103 performs primary transfer of the toner images onto an intermediate transfer member 110. In an image forming apparatus that forms a multicolor image, four developing units are provided arranged in order cyan (C), magenta (M), yellow (Y), and black (K). The toner image that has undergone primary transfer onto the intermediate transfer member 110 then undergoes secondary transfer onto a sheet fed from any of feeding units 106, 107, or 108. A fixing unit 109 fixes the toner image onto the sheet.

Configuration and Basic Operations of LED Exposure Unit

Figure 2:
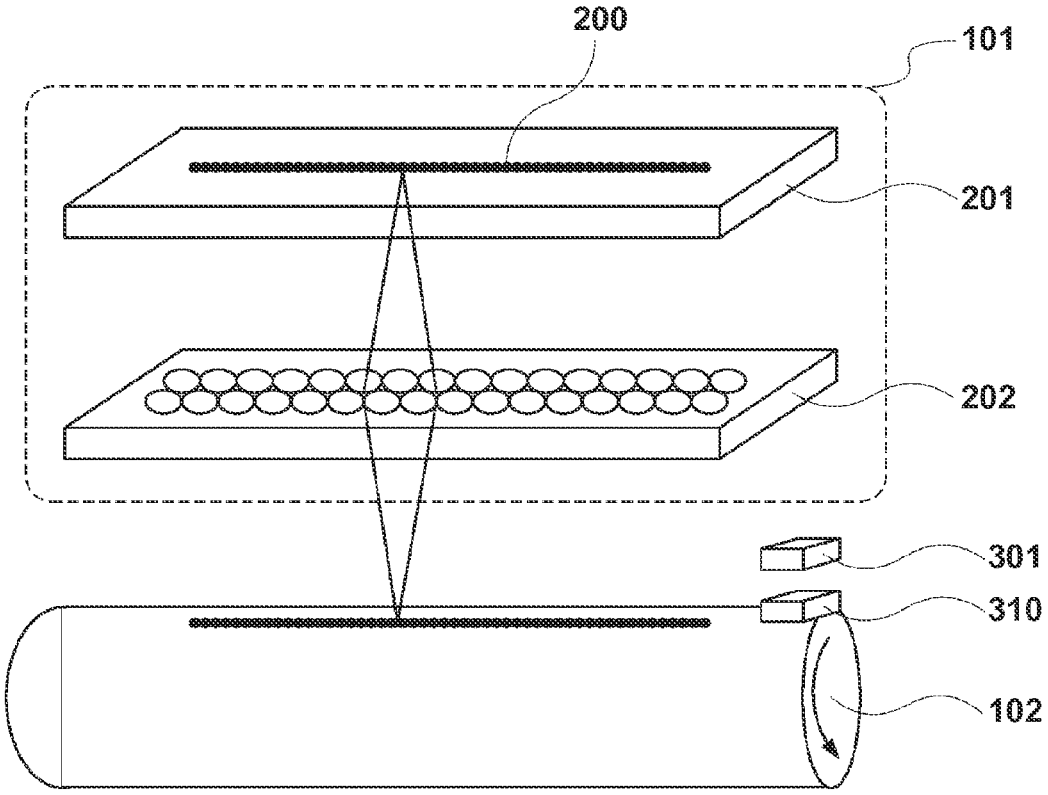
FIG. 2 is a diagram showing a configuration of an LED exposure unit.

Description is given using FIG. 2 of a configuration and basic operations of the LED exposure unit 101. An LED array 200 is provided with multiple light emitting elements arranged in a single straight line that output light towards the photosensitive drum 102. The multiple light emitting elements are arranged so that each of the multiple light emitting elements exposes the different position on the photosensitive drum 102 in a rotational axis (shaft) direction. The multiple light emitting elements are positioned substantially parallel to the rotational shaft of the photosensitive drum 102. Accordingly, by causing each of the light emitting elements of the LED array 200 to emit light, a single line is formed at one time in the main scanning direction. The multiple light emitting elements of the LED array 200 are supported by a support substrate 201. A rod lens array 202 is provided with multiple imaging lenses (rod lenses) that causes light from the light emitting elements to form an image onto the surface of the image carrier. The LED array 200, the support substrate 201, and the rod lens array 202 constitute a printhead unit. Since the light outputted from each of the light emitting elements is divergent light, it forms an image (condensed) onto the photosensitive drum 102 by an imaging lens. A single pixel is formed by light forming an image onto the photosensitive drum by the light being outputted from a single light emitting element and passing through the imaging lens. The relative relationship of the position of the light emitting elements, the position of the imaging lens, and the position of the photosensitive drum is determined so that the image-forming position of the light outputted from each of the light emitting elements on the photosensitive drum achieves a desired area and position.

Here, the image-forming position in an ideal state in which there is no bending of the support substrate 201 and no decentering of the photosensitive drum 102 is referred to as the ideal position. In reality, bending of the support substrate 201 and decentering of the photosensitive drum 102 do exist, and therefore the image-forming position of each light emitting element (exposure area) displaces from the ideal position, thereby becoming a cause of the aforementioned expansion of the spot size (exposure area corresponding to a single pixel). A home position sensor 301 is a detection unit that outputs a detection signal when a reference mark 310 indicating a home position of the photosensitive drum 102 is detected. The detection signal is outputted one time for each single rotation of the photosensitive drum 102. The reference mark 310 is provided at an end portion of the photosensitive drum 102 so as to not affect the toner image. By resetting and starting a counter using a timing by which the home position sensor 301 outputs the detection signal, the counter value of the counter expresses an absolute position of the photosensitive drum 102 in the sub scanning direction. Here, the absolute position in the sub scanning direction is a position on the surface of the photosensitive drum 102 referenced on the reference mark 310 and is an invariant position. Accordingly, which position of the photosensitive drum 102 in the sub scanning direction is being illuminated can be understood by referencing the counter value. It should be noted that the LED exposure unit 101 is also sometimes referred to as a printhead unit. One of the LED exposure units 101 is provided for each of YMCK respectively.

Figure 3:
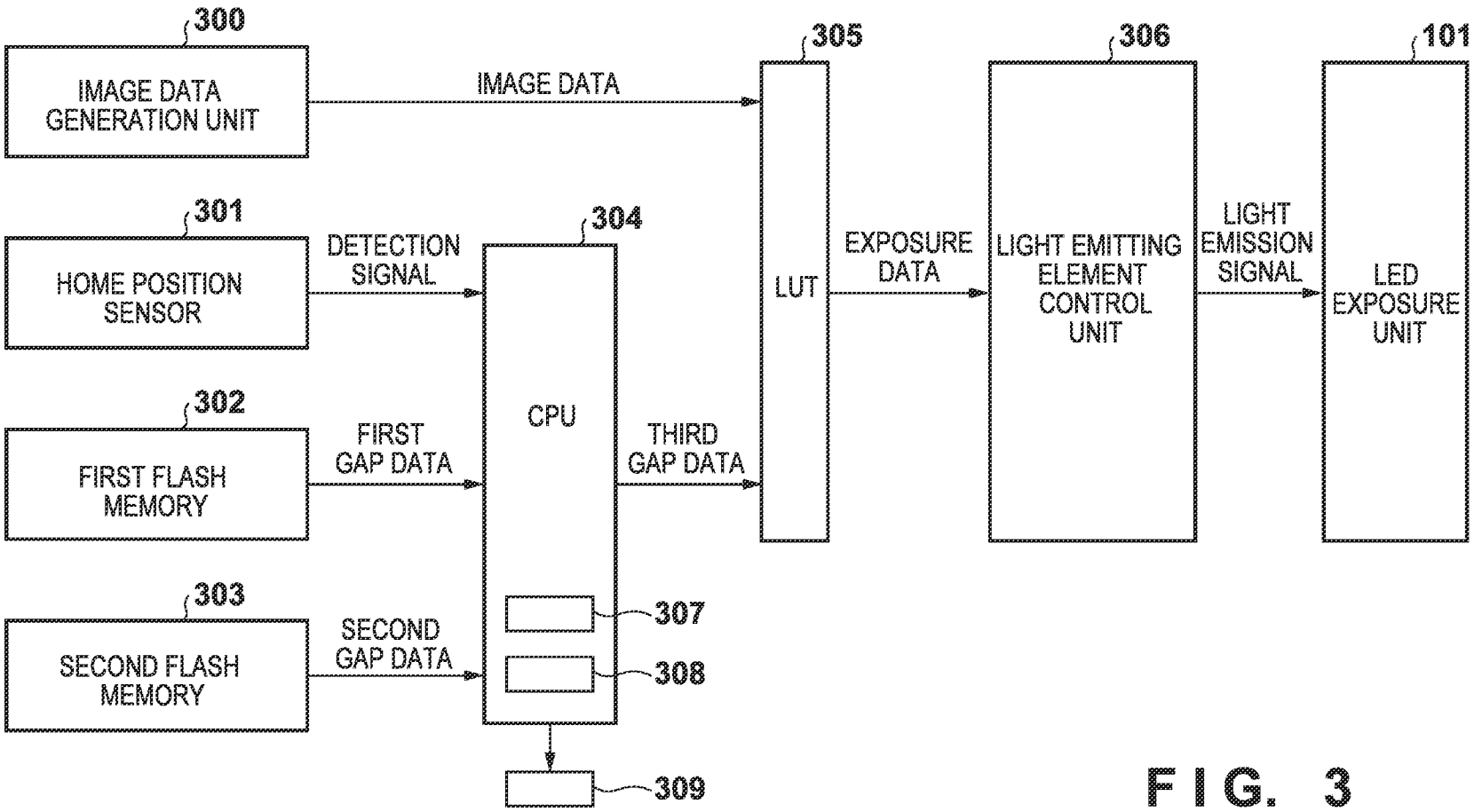
FIG. 3 is a diagram showing a control unit of the image forming apparatus.

Description is given using FIG. 3 regarding a control unit of the image forming apparatus 1. A CPU 304 is a control unit that performs overall control of the entire image forming apparatus 1. An image data generation unit 300 generates YMCK image data by executing color conversion and gamma corrections and the like on RGB image signals outputted from the image reader 100.

A first flash memory 302 and a second flash memory 303 function as a gap data storage unit. The first flash memory 302 stores first gap data that indicates displacement of the image-forming position from the ideal position occurring due to bending of a portion of the support substrate 201 in a direction approaching the photosensitive drum 102. The first gap data is data that expresses a distance from the LED exposure unit 101 to the multiple exposure areas respectively that constitute the surface of the photosensitive drum 102. The distance indicated by the first gap data is the shortest distance between the LED exposure unit 101 and the exposure area. That is, this distance is a distance between the LED exposure unit 101 and the exposure area when the relevant exposure area has come directly under the LED exposure unit 101 (when the LED exposure unit 101 and the exposure area oppose each other) due to the rotation of the photosensitive drum 102. The second flash memory 303 stores second gap data that indicates displacement from each exposure area of the photosensitive drum 102 to the ideal position occurring due to decentering of the photosensitive drum 102. The distance indicated by the second gap data is the distance from the relevant exposure area to the ideal position when the exposure area has come directly under the LED exposure unit 101. Basically, these sets of data are stored at the time of shipment from the factory. Furthermore, the first gap data is different data for each of the separate LED exposure units 101. The second gap data is different data for each of the separate photosensitive drums 102. Accordingly, it is necessary to update these sets of gap data when the LED exposure unit 101 or the photosensitive drum 102 is replaced. The CPU 304 is provided with a counter 307 that is realized by hardware or software, and the counter 307 is caused to reset and restart each time the home position sensor 301 outputs the detection signal. A timer may be employed instead of the counter 307. The CPU 304 reads out from the first flash memory 302 and the second flash memory 303 the first and second gap data respectively that are stored at addresses corresponding to the count value of the counter 307. Further still, the CPU 304 may obtain third gap data by adding these sets of gap data. It should be noted that the CPU 304 may obtain the third gap data by reading out the gap data and storing it in a RAM 308 without using the counter 307. In this case, the third gap data stored at an address corresponding to the count value of the counter 307 may be read out from the RAM 308. A LUT unit 305 functions as a light amount control data storage unit that stores light amount control data that is preset for each exposure area so that the spot size becomes substantially constant in response to the distance from the LED exposure unit 101 to each of the multiple exposure areas constituting the surface of the photosensitive drum 102.

Furthermore, the LUT unit 305, the CPU 304, and a light emitting element control unit 306 function as a control unit that controls the light amount of light for forming an image at each of the multiple exposure areas in accordance with the light amount control data corresponding to the multiple exposure areas in response to the distance from the head unit to the multiple exposure areas of the image carrier opposing the head unit. It should be noted that reference is made to the head unit opposing the image carrier and this is not only in a case where the head unit and the image carrier always face each other in a face to face manner, but also in a case where the optical path between the head unit and the image carrier is bended by a reflector. Accordingly, the aforementioned distance signifies the distance along this optical path. In this way, the LUT unit 305 is constituted by a memory, in which is stored a lookup table, and an arithmetic unit. It should be noted that the LUT unit 305 may be simply configured as a lookup table only by incorporating the arithmetic unit in the CPU 304. The LUT unit 305 generates light amount control data by performing tone correction on the image data inputted from the image data generation unit 300 using correction amounts corresponding to the third gap data inputted from the CPU 304. That is, the LUT unit 305 converts the image data to light amount control data in response to the third gap data. The light emitting element control unit 306 controls the light amount of each of the light emitting elements in accordance with the light amount control data outputted from the LUT unit 305. A display device 309 is an output unit that outputs information such as messages or the like.

Light Amount Control Method

In the present working example, the light amounts are controlled by using the LUT unit 305 to correct the image data for each two dimensional exposure area obtained by expanding the circumferential surface of the photosensitive drum 102 based on data relating to bending of the support substrate 201 and data relating to the decentering amount of the photosensitive drum 102. Due to this, it becomes possible to reduce the expansion of spot sizes caused by bending of the support substrate 201 and decentering of the photosensitive drum 102. That is, the spot size of light on the photosensitive drum 102 can be reduced by reducing the light amount.

Figure 4A:
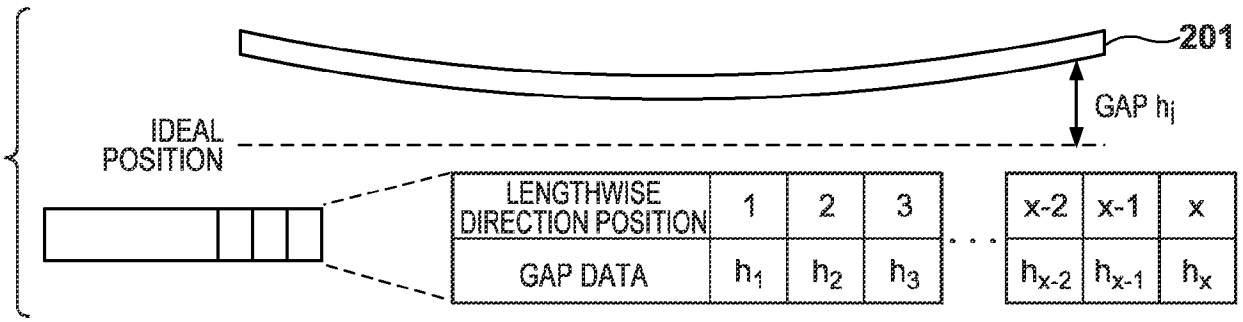
FIGS. 4A to 4C are diagrams showing displacement of image-forming positions due to bending of a support substrate and decentering of a photosensitive drum.
Figure 4B:
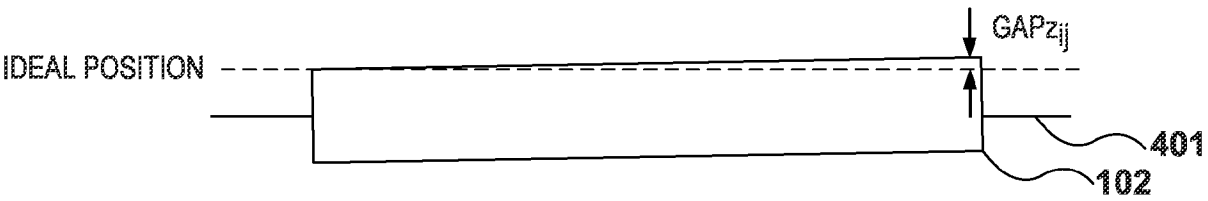
Figure 4C:
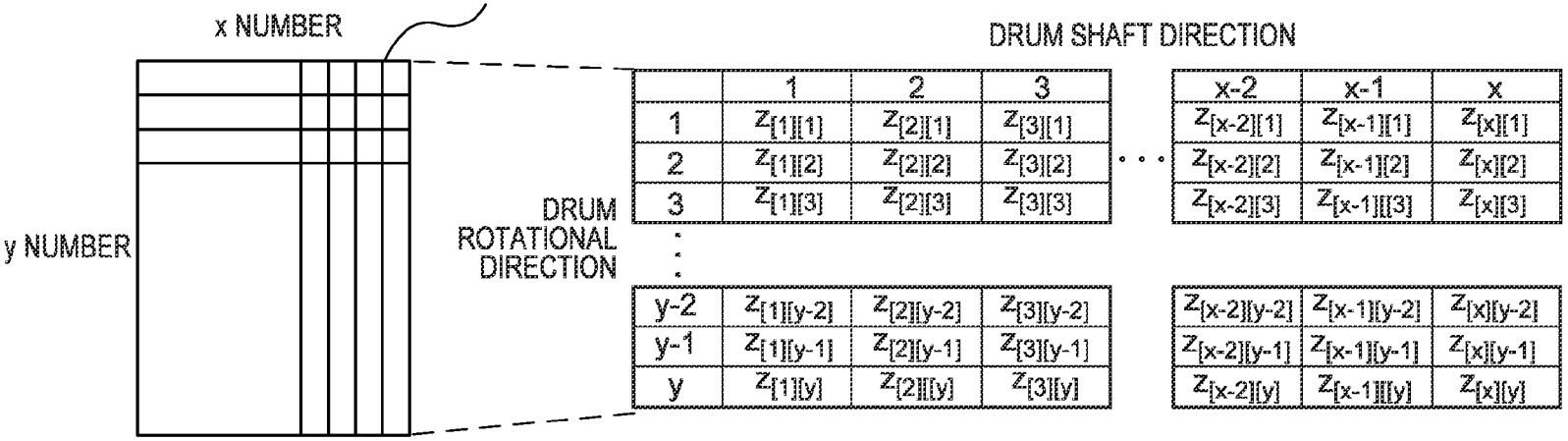

While associating the bending of the support substrate 201 shown in FIG. 4A with the image of decentering of the photosensitive drum 102 shown in FIG. 4B, description is given using FIG. 4C regarding a method for obtaining gap data. As shown in FIG. 4A, first gap data $h_i$ (i is a natural number from 1 to x) indicating bending of the support substrate 201 is prepared in advance for each position x (x is an arbitrary natural number) of the support substrate 201 in the lengthwise direction (shaft direction of the photosensitive drum 102). For example, the first gap data $h_i$ indicates a distance from each of an x number of light emitting element blocks of the support substrate 201 to an ideal image-forming position (ideal position). Here, a single light emitting element block is constituted by multiple light emitting elements. The light emitting element blocks and the exposure areas on the photosensitive drum 102 correspond one-to-one. Here, the first gap data $h_i$ corresponding to the i-th exposure area in the main scanning direction may be an average value or the smallest value of the distance from each of the multiple light emitting elements constituting the corresponding i-th light emitting element block to the ideal position. In a case where a single light emitting element block is constituted by a single light emitting element, the distance itself from that light emitting element to the ideal position is the first gap data $h_i$. The first gap data $h_i$ is measured by a jig or a measurement tool when shipping from the factory and stored in the first flash memory 302.

As shown in FIG. 4B, the second gap data, which is information of decentering of a rotational shaft 401 of the photosensitive drum 102, is data that indicates the distance from each of the exposure areas of the photosensitive drum 102 to the ideal position. As shown in FIG. 4C, a rectangle 402 is obtained when the circumferential surface of the photosensitive drum 102 is expanded using the home position as a reference. This rectangle 402 is further divided into the x number of exposure areas in the drum shaft direction, and divided into a y number (y is an arbitrary natural number) in the drum rotational direction. In other words, the circumferential surface is divided into an x×y number of exposure areas using the home position as an origin. The distance to the ideal position can be different for each of the x×y number of exposure areas. For this reason, second gap data $z_{ij}$ is measured in advance using a jig or measurement tool for each of the exposure areas and stored in the second flash memory 303 (j is a natural number from 1 to y).

The CPU 304 reads out the first gap data $h_i$ from the first flash memory 302 in accordance with a variable i that indicates the x direction position. Further still, the CPU 304 reads out the second gap data $z_{ij}$ from the second flash memory 303 in accordance with the variable i, which indicates the x direction position, and a variable j, which indicates the y direction position. The CPU 304 adds the first gap data $h_i$ and the second gap data $z_{ij}$ for each of the exposure areas to obtain third gap data $t_{ij}$.

$$h_i+z_{ij}=t_{ij} \tag{1}$$

The third gap data $t_{ij}$ obtained here is gap data corresponding to each x×y number of exposure areas on the photosensitive drum 102. The CPU 304 may store the third gap data $t_{ij}$ in advance in the RAM 308 and read out the third gap data $t_{ij}$ from the RAM 308 when executing printing. In this case, it becomes possible to save the time and effort of obtaining the third gap data $t_{ij}$ at each time of executing printing.

Figures 5A, 5B, 5C, 5D:
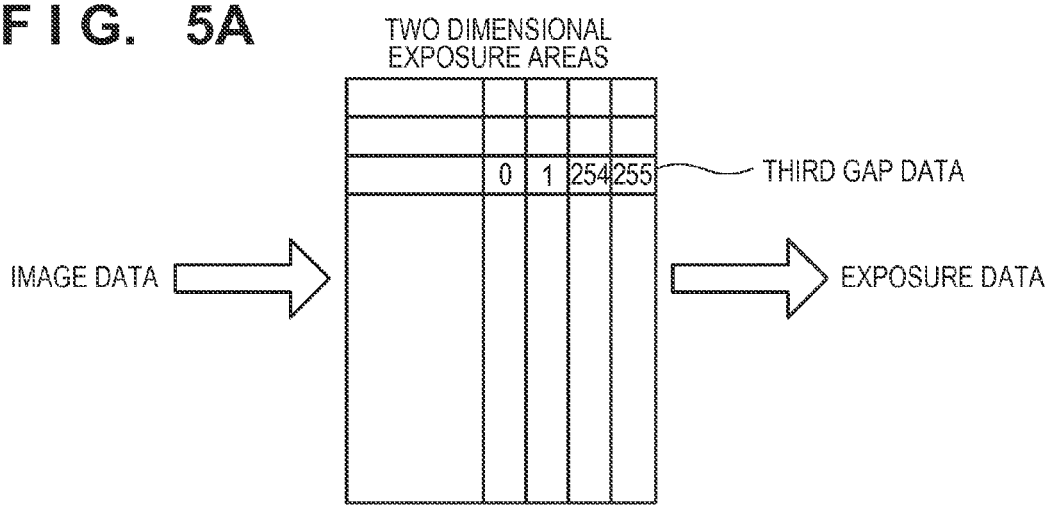
FIGS. 5A to 5D are diagrams showing image data conversion processing using a LUT.

As shown in FIG. 5A, the third gap data $t_{ij}$ can be used when converting the image data inputted from the image data generation unit 300 to light amount control data by the LUT unit 305. That is, light amount control data is determined for each light emitting element (exposure area) dependent on the third gap data.

Specific description is given using FIG. 5B regarding a LUT conversion process. The LUT unit 305 has a table in which is held the light amount control data associated with pairings of the third gap data and density data (tone data) of the image. In this example, the inputted image data has 256 tones and the third gap data is data in units of 100 μm from 0 to 25.5 mm. These specific numerical values are merely one example.

The LUT unit 305 determines the light amount control data associated with pairings of the inputted image data and the third gap data $t_{ij}$ by referencing the table. For example, if the third gap data is "1" and the image data is "1," then the light amount control data becomes "2." Note that in a case where the value of the third gap data $t_{ij}$ exceeds the gap setting range of the LUT unit 305, the CPU 304 may output information to the display device 309 indicating an abnormality. Furthermore, this information may be a message prompting replacement of the photosensitive drum 102 or the LED exposure unit 101. This enables the spot size to be maintained since an operator of the image forming apparatus 1 can replace the photosensitive drum 102 or the LED exposure unit 101.

Figure 6A:
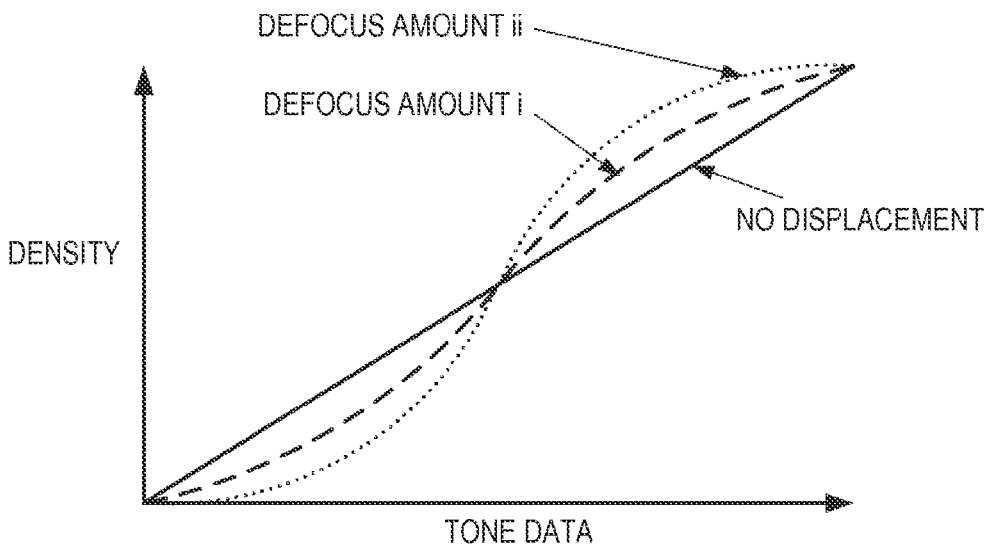
FIGS. 6A and 6B are diagrams showing tone density changes due to defocus.
Figure 6B:
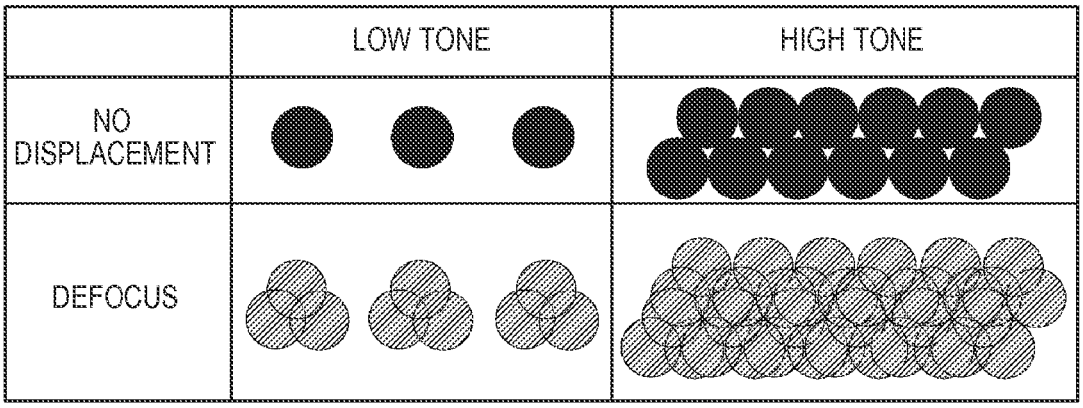

Description is given using FIG. 6A and FIG. 6B regarding a method for determining light amount control data to be set in the table provided in the LUT unit 305. As shown in FIG. 6A, tone data (density data) has a characteristic by which the tone becomes lower in low tone regions and the tone becomes higher in high tone regions in response to the displacement amount of the image-forming position (defocus amounts i and ii). That is, density data has a characteristic by which the density becomes lighter in low tone regions and the density becomes darker in high tone regions. FIG. 6B shows this phenomenon in an easy to understand manner. FIG. 6B indicates the reproducibility of low tone regions and high tone regions for an ideal case, in which the defocus amount is zero, and a case in which the defocus amount is a significant value. As shown in FIG. 6B, when the defocus amount becomes large, the density becomes lighter than the target density in low tone regions since highlights are washed out due to dot dispersion. Furthermore, when the defocus amount becomes large, the density becomes darker than the target density in high tone regions since neighboring dots overlap and the gaps between dots are filled in. Accordingly, in accordance with the third gap data, the LUT unit 305 corrects the tone data for low tone regions so that the density becomes darker and corrects the tone data for high tone regions so that the density becomes lighter.

FIG. 5C shows one example of input and output of the LUT unit 305 corresponding to the defocus amount i. FIG. 5D shows one example of input and output of the LUT unit 305 corresponding to the defocus amount ii. As shown in FIG. 6A, the defocus amount ii is much greater than the defocus amount i. For this reason, the density correction amounts also are much greater correction amounts for the defocus amount ii than the defocus amount i. For example, in a case where the input image data is "2," the light amount control data is "3" for the defocus amount i, but the light amount control data is "4" for the defocus amount ii. Similarly, in a case where the input image data is "252," the light amount control data is "251" for the defocus amount i, but the light amount control data is "250" for the defocus amount ii. In this way, the LUT unit 305 has a table by which light amount control data is outputted for performing correction to make the image density darker in a case where the image density is relatively low density, and light amount control data is outputted for performing correction to make the image density lighter in a case where the image density is relatively high density.

Figure 7:
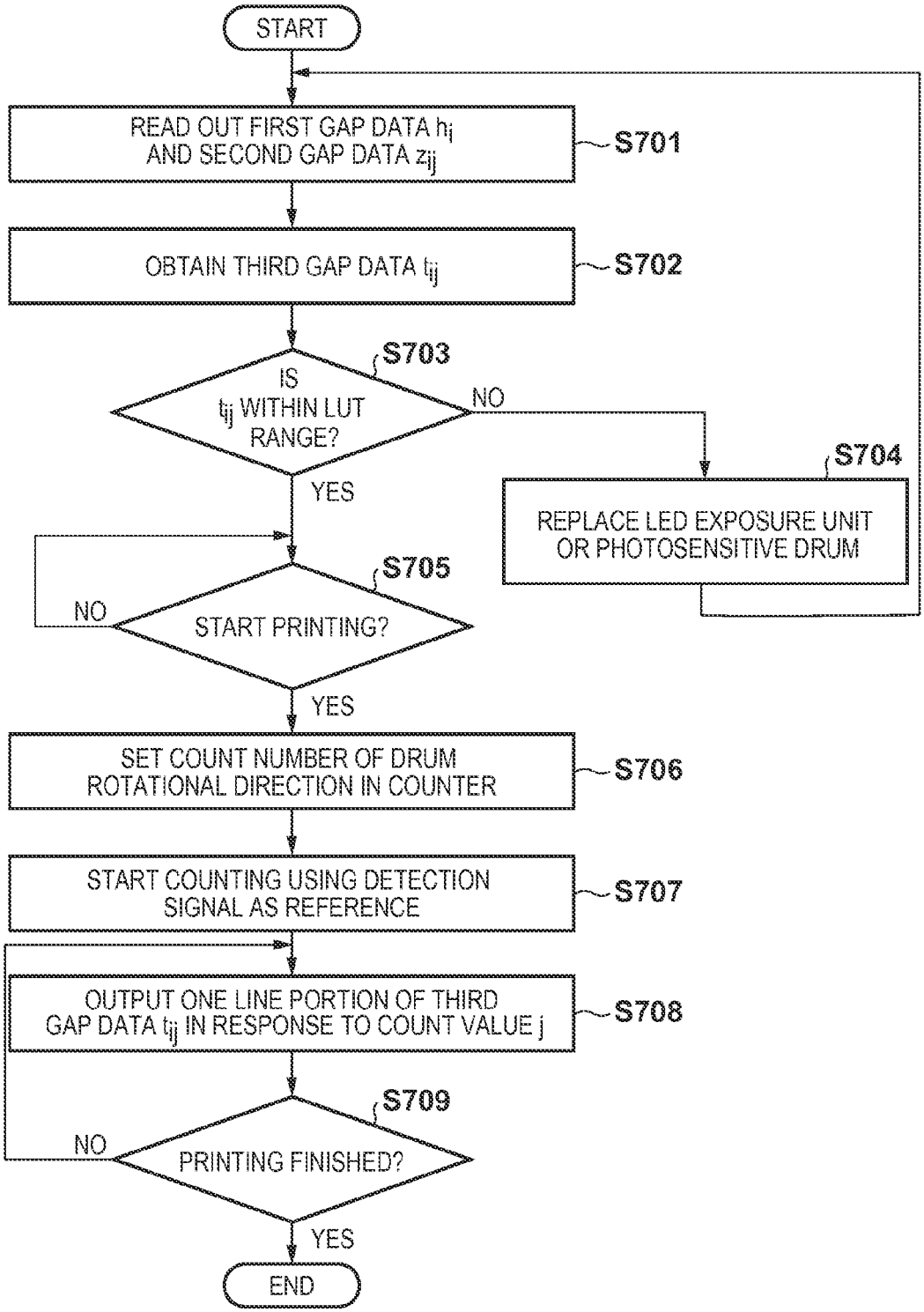
FIG. 7 is a diagram showing a flowchart according to a present working example.

Description is given using FIG. 7 regarding operation of the CPU 304. When the image forming apparatus 1 is powered up, the CPU 304 executes processing according to the flowchart shown in FIG. 7.

At S701, the CPU 304 reads out the first gap data hi stored in the first flash memory 302 and the second gap data $z_{ij}$ stored in the second flash memory 303. The variable i and the variable j may be counted by a counter.

At S702, the CPU 304 adds the first gap data hi and the second gap data $z_{ij}$ to obtain the third gap data $t_{ij}$ corresponding to each of the exposure areas, and stores this in the RAM 308. In this way, the CPU 304 functions as an adding unit that obtains the third gap data by adding the first gap data and the second gap data.

At S703, the CPU 304 determines whether or not all the third gap data $t_{ij}$ fits within a gap range (example: 0 to 25.5 mm) in the table of the LUT unit 305. If the third gap data $t_{ij}$ is not within the gap range, the procedure proceeds to S704.

At S704, the CPU 304 outputs through the display device 309 a message prompting replacement of the photosensitive drum 102 or the LED exposure unit 101. It should be noted that when the photosensitive drum 102 or the LED exposure unit 101 is replaced, the stored contents of the first flash memory 302 and the second flash memory 303 are updated to stored contents corresponding to the new photosensitive drum 102 or LED exposure unit 101. These second flash memories 303 may be mounted on a process cartridge included in the photosensitive drum 102. Similarly, the first flash memory 302 may be provided in the LED exposure unit 101. In this case, by writing data to these flash memories at the time of shipping these replacement components from the factory, it becomes possible to save the time and effort of a maintenance worker writing the data at the actual location. After this, the procedure returns to S701.

On the other hand, if the third gap data $t_{ij}$ is within the gap range, the procedure proceeds to S705. At S705, the CPU 304 determines whether or not a print start instruction has been inputted from an operation unit not shown in the diagrams. When a print start instruction is inputted, the procedure proceeds to S706.

At S706, the CPU 304 sets in the counter 307 a count number for specifying positions of the photosensitive drum 102 in the rotational direction. This count number corresponds to the largest value y of the variable j in the third gap data $t_{ij}$. In this way, the counter 307 counts from 1 to y.

At S707, the CPU 304 commences counting of the counter 307 using a timing at which the home position sensor 301 outputs a detection signal.

At S708, the CPU 304 reads out from the RAM 308 one line portion of the third gap data $t_{ij}$ corresponding to the count value j of the counter 307 and outputs this to the LUT unit 305. The LUT unit 305 corrects one line portion of image data in the main scanning direction according to the corresponding one line portion of third gap data $t_{ij}$ and outputs one line portion of light amount control data. For example, the light amount control data for controlling the light emitting element that is to irradiate light onto the i-th exposure area in the main scanning direction is read out from the table of the LUT unit 305 as light amount control data corresponding to a pairing of tone data of the i-th exposure area and the third gap data $t_{ij}$. Here, the third gap data is data corresponding to the first gap data and the second gap data. For this reason, reading out the light amount control data corresponding to the third gap data is equivalent to reading out light amount control data corresponding to the first gap data and the second gap data. In this case, the LUT unit 305 functions as a light amount control data storage unit that stores light amount control data corresponding to the first gap data and the second gap data. Furthermore, the CPU 304 functions as a determination unit that determines from the table the light amount control data associated with pairings of the third gap data and density data (tone data) indicating image density.

In this regard, in a case where a signal pixel of image data and a light emitting element correspond one-to-one, normally the i-th exposure area is illuminated by multiple light emitting elements. That is, the same third gap data $t_{ij}$ is applied to the tone data of the multiple pixels formed in the i-th exposure area. The same is true in regard to the sub scanning direction in that the same third gap data $t_{ij}$ is applied to the tone data of the multiple pixels formed in the j-th exposure area. It should be noted that the variable i is incremented by one in accordance with the number of pixels in the main scanning direction constituting a single exposure area. For example, in a case where the main scanning direction length of a single exposure area corresponds to the length of five pixels in the main scanning direction, the variable i is incremented by one each time five pixels are processed. On the other hand, the variable j is incremented by one in accordance with the number of pixels in the sub scanning direction constituting a single exposure area. For example, in a case where the sub scanning direction length of a single exposure area corresponds to the length of ten pixels, the variable j is incremented by one each time ten pixels (a line) in the sub scanning direction are processed.

At step S709, the CPU 304 determines whether or not printing has finished for all the image data. If printing is not finished, the procedure returns to S708, and if printing is finished, the present process finishes.

According to the present working example, the light amounts of light emitting elements are controlled using light amount control data corrected in advance so that the spot size becomes substantially constant in response to the gap from the LED exposure unit 101 to the multiple exposure areas constituting the surface of the photosensitive drum 102.

Accordingly, with the present working example, fluctuation in spot size can be mitigated using a simple configuration without requiring a mechanical adjustment mechanism or a reading unit for sample images. It should be noted that the present working example can also be applied to image forming apparatuses having a mechanical adjustment mechanism. Since there are certain limitations to the adjustable range using a mechanical adjustment mechanism, fine adjustments of the spot size may be performed using the present working example. Furthermore, with the present working example, expansion of the spot size is suppressed, and therefore density unevenness in images is reduced, which also reduces color shifts in multicolor images.

Notably, light amount control data is used that has been corrected in response to the first gap data that indicates displacement of the image-forming position occurring due to bending of a portion of the support substrate 201 in a direction approaching the photosensitive drum 102. Due to this, it becomes possible to reduce the expansion of spot sizes caused by bending of the support substrate 201. Furthermore, by using light amount control data corrected in response to second gap data that indicates displacement to an ideal position from exposure areas occurring due to decentering of the photosensitive drum 102, spot size expansion caused by decentering of the photosensitive drum 102 can be reduced.

Furthermore, by using the home position sensor 301 to detect the reference mark 310 provided on the photosensitive drum 102 and performing counting using the counter 307 referenced on the detection signal thereof, gap data and light amount control data corresponding to each of the exposure areas can be obtained easily.

Further still, light amount control data is outputted for performing correction to make the image density darker in a case where the image density is relatively low density, and light amount control data is outputted for performing correction to make the image density lighter in a case where the image density is relatively high density, thereby enabling density unevenness to be reduced appropriately in response to the defocus amount.

Furthermore, the gap data may be corrected in response to the number of sheets of image forming or usage time of the image forming apparatus 1, and the gap data may be updated by a maintenance worker carrying out actual measurements. In this case, even if there is gap fluctuation after the image forming apparatus 1 has been shipped, this can be handled sufficiently. Note however that expansion of spot sizes cannot be corrected sufficiently when there is severe wear of the photosensitive drum 102 or when there is large bending of the support substrate 201. Consequently, in cases such as these, the display device 309 may output a message prompting replacement of these.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-278752, filed Dec. 20, 2011 which is hereby incorporated by reference herein in its entirety.

What is claimed is:

1. An image forming apparatus, comprising:

a head unit provided with multiple light emitting elements, which output light toward a rotationally driven image carrier and are disposed so as to illuminate different positions of the image carrier in a rotational axis of the image carrier, and multiple imaging lenses, which cause light from the light emitting elements to form an image onto a surface of the image carrier, a support substrate configured to support the multiple light emitting elements, a light amount control data storage unit configured to store light amount control data corresponding to multiple exposure areas respectively on the image carrier in the rotational direction of the image carrier, and a control unit configured to control a light amount of the light outputted from the multiple light emitting elements respectively based on light amount control data corresponding to the exposure areas opposing the multiple light emitting elements respectively by reading out from the light amount control data storage unit the light amount control data corresponding to displacement from an ideal position of an image forming position of light from the multiple light emitting elements occurring due to bending of a portion of the support substrate in a direction approaching the image carrier and/or displacement from the multiple exposure areas respectively to the ideal position occurring due to decentering of the image carrier.

2. The image forming apparatus according to claim 1, further comprising:

a gap data storage unit in which first gap data that indicates displacement from an ideal position of an image-forming position of light from the multiple light emitting elements occurring due to bending of a portion of the support substrate in a direction approaching the image carrier, and second gap data indicating displacement from the multiple exposure areas respectively to the ideal position occurring due to decentering of the image carrier are stored as data expressing a distance from the head unit to the multiple exposure areas respectively that constitute a surface of the image carrier, wherein the control unit controls the light amount by reading out the first gap data and the second gap data for each of the multiple exposure areas from the gap data storage unit and reading out the light amount control data corresponding to the first gap data and the second gap data from the light amount control data storage unit.

3. The image forming apparatus according to claim 2, wherein the light amount control data storage unit, stores a table that holds the light amount control data associated with pairings of gap data and density data indicating image density, and wherein the control unit comprises:

an adding unit configured to obtain third gap data by adding the first gap data and the second gap data, and a determination unit configured to determine the light amount control data corresponding to the first gap data and the second gap data by reading out from the table the light amount control data associated with pairings of the third gap data and image density data.

4. The image forming apparatus according to claim 3, wherein the table is a table by which light amount control data is outputted for performing correction to make the image density darker in a case where the image density is relatively low density, and light amount control data is outputted for performing correction to make the image density lighter in a case where the image density is relatively high density.

5. The image forming apparatus according to claim 3, further comprising:

an output unit configured to output a message prompting replacement of the image carrier or the head unit in a case where the light amount control data associated with the third gap data obtained by the adding unit is not stored in the light amount control data storage unit.

6. The image forming apparatus according to claim 4, further comprising:

an output unit configured to output a message prompting replacement of the image carrier or the head unit in a case where the light amount control data associated with the third gap data obtained by the adding unit is not stored in the light amount control data storage unit.

7. The image forming apparatus according to claim 1, wherein the multiple light emitting elements are arranged in a single line in a rotational axis of the image carrier.

8. An exposure device, comprising:

a head unit provided with multiple light emitting elements arranged in a single line in a rotational axis of the image carrier and multiple imaging lenses that cause light from the multiple light emitting elements to form an image onto a surface of an object to be scanned, a support substrate configured to support the multiple light emitting elements, a storage unit configured to store light amount control data corresponding to multiple exposure areas respectively on the object to be scanned in the rotational direction of the object to be scanned, and a control unit configured to control a light amount of the light for forming an image at each of multiple exposure areas in accordance with light amount control data corresponding to the multiple exposure areas in response to a distance from the head unit to the multiple exposure areas of the object to be scanned opposing the head unit by reading out from the storage unit the light amount control data corresponding to displacement from an ideal position of an exposure position of light from the multiple light emitting elements occurring due to bending of a portion of the support substrate in a direction approaching the object to be scanned and/or displacement from the multiple exposure areas respectively to the ideal position occurring due to decentering of the object to be scanned.

9. A controller, comprising:

a holding unit configured to hold light amount control data corresponding to multiple exposure areas respectively in response to a distance from a head unit, which is provided with multiple light emitting elements arranged in a line in a rotational axis of the image carrier and multiple imaging lenses that cause light from the multiple light emitting elements to form an image onto a surface of an object to be scanned, to the multiple exposure areas of the object to be scanned opposing the head unit, a support substrate configured to support the multiple light emitting elements, a storage unit configured to store light amount control data corresponding to multiple exposure areas respectively on the object to be scanned in the rotational direction of the object to be scanned, and a control unit configured to read out from the holding unit light amount control data corresponding to the multiple exposure areas respectively to control a light amount of the light for forming an image onto the multiple exposure areas respectively by reading out from the storage unit the light amount control data corresponding to displacement from an ideal position of an exposure position of light from the multiple light emitting elements occurring due to bending of a portion of the support substrate in a direction approaching the object to be scanned and/or displacement from the multiple exposure areas respectively to the ideal position occurring due to decentering of the object to be scanned.

* * * * *